US007039344B2

(12) United States Patent
Nishiyama

(10) Patent No.: US 7,039,344 B2
(45) Date of Patent: May 2, 2006

(54) DEVELOPING APPARATUS INCLUDING FIRST AND SECOND DEVELOPER CHAMBERS AND FEEDING MEMBER DISPOSED IN THE SECOND DEVELOPER CHAMBER FOR REGULATING A DEVELOPER LEVEL

(75) Inventor: Kazushige Nishiyama, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 114 days.

(21) Appl. No.: 10/795,258

(22) Filed: Mar. 9, 2004

(65) Prior Publication Data

US 2004/0179865 A1 Sep. 16, 2004

(30) Foreign Application Priority Data

Mar. 10, 2003 (JP) ..... 2003-064200

(51) Int. Cl.
*G03G 15/08* (2006.01)

(52) U.S. Cl. ..... 399/254; 399/258

(58) Field of Classification Search ..... 399/254, 399/256, 258

See application file for complete search history.

(56) References Cited

U.S. PATENT DOCUMENTS

| | | | | |
|---|---|---|---|---|
| 4,942,431 | A * | 7/1990 | Tada | 399/58 |
| 5,005,517 | A * | 4/1991 | Fukui et al. | 399/258 X |
| 5,887,224 | A * | 3/1999 | Mizuishi et al. | 399/256 X |
| 6,281,961 | B1 * | 8/2001 | Sako et al. | 399/254 X |
| 2004/0086301 | A1 * | 5/2004 | Tamura | 399/258 X |

* cited by examiner

*Primary Examiner*—Sophia S. Chen
(74) *Attorney, Agent, or Firm*—Fitzpatrick, Cella, Harper & Scinto

(57) ABSTRACT

A two-component developing apparatus is provided with a developer carrying member for carrying the developer thereon to an image bearing member. An agitating chamber is provided with a screw member provided with fins on the rotary shaft thereof for agitating and carrying the developer, and a receiving port for receiving a supplied toner therein, and constituting a circulation route for the developer together with the developing chamber, more fins are provided in a second area spaced apart by a predetermined distance and more from the receiving port toward the downstream side thereof with respect to a developer carrying direction than in a first area near the receiving port.

3 Claims, 13 Drawing Sheets

DEVELOPING APPARATUS INCLUDING FIRST AND SECOND DEVELOPER CHAMBERS AND FEEDING MEMBER DISPOSED IN THE SECOND DEVELOPER CHAMBER FOR REGULATING A DEVELOPER LEVEL

BACKGROUND OF THE INVENTION

1. Field of the Invention

The invention relates to a developing apparatus for use in a copying machine, a laser beam printer, a facsimile apparatus a printing apparatus or the like using an electrophotographic process or an electrostatic recording process.

2. Description of Related Art

Heretofore, in visualizing an electrostatic latent image formed on an image bearing member, there has been widely used a two-component developing method using a two-component developer comprising a nonmagnetic toner and a magnetic carrier. In this two-component developing method, the developer agitated by agitating means in a developing apparatus is carried on a developer carrying member having therein a magnet which is magnetic field generating means, and the electrostatic latent image is visualized in a portion opposed to the image bearing member by the use of this developer.

In a two-component developing apparatus adopting such a two-component developing method, only the toner is supplied for use from a toner supplying container discretely provided and therefore, the toner density (i.e., the rate of the toner particle weight to the total weight of carrier particles and toner particles) of the two-component developer is a very important factor in stabilizing the quality of an image.

Now, the toner particles in the developer are consumed during development and therefore the toner density changes at all times. Thus, it is necessary to accurately detect the toner density of the developer at a suitable time by the use of a developer density controller (ATR), effect toner supply in conformity with changes in the toner density, effect agitation sufficiently and control the toner density always at a constant level to thereby maintain the excellence of an image.

In order to correct the changes in the toner density in the developing apparatus by developing, as described above, that is, in order to control the amount of toner supplied to the developing apparatus, as a toner density detector and a density controller for the developer in a developing container, a number of various types have heretofore been put into practical use.

Use is made, for example, of a developer density controller installed at a location proximate to a developing sleeve or the developer carrying route of the developing container, for detecting and controlling the toner density by the utilization of the fact that the developer carried onto the developing sleeve or the developer in the developing container differs in the reflectance when light is applied thereto depending on the toner density, or a developer density controller of an inductance detection type designed to detect the density of the toner in the developing container by a detection signal from an inductance head for detecting the apparent permeability by the mixing ratio between the magnetic carrier and the nonmagnetic toner on the side wall of the developer and converting it into an electrical signal, and supply the toner by the comparison thereof with a reference value.

Also, there is a method whereby the density of a patch image formed on a photosensitive drum as an image bearing member is read by a light source provided at a location opposed to the surface of the photosensitive drum and a sensor for receiving the reflected light thereof, and the read image density is converted into a digital signal by an analog-to-digital converter and thereafter is sent to a CPU, and if in the CPU, the density is higher than an initial set value, toner supply is stopped until the density restores the initial set value, and if the density is lower than the initial set value, the toner is forcibly supplied until the density is restored to the initial set value, and as a result, the toner density is indirectly maintained at a desired value.

A popular two-component developing apparatus will be described here with reference to FIG. 14A of the accompanying drawings.

In FIG. 14A, the developing apparatus 400 is comprised of a developing container 10 containing a developer therein, a developing sleeve 1 which is a developer carrying member which is a rotary hollow cylinder, a magnet roller 2 which is magnetic field generating means fixedly disposed in the developing sleeve 1 relative to the rotation thereof, carrying screws 4*a* and 5*a* which are developer agitating and carrying means disposed in the developing container 10, and a regulating blade 3 which is a developer layer thickness regulating member disposed to form a thin layer of developer on the surface of the developing sleeve 1.

A design is made such that a DC bias and an AC bias are applied from a voltage source (not shown) to the developing sleeve 1. Generally, when the AC bias is applied, developing efficiency increases and an image assumes high excellence.

Here, a description will be made of a developing step of visualizing an electrostatic latent image formed on a photosensitive drum 103 which is an image bearing member by a two-component magnetic brush method by the use of the developing apparatus 400 shown in FIGS. 14A and 14B of the accompanying drawings, and a developer circulating system.

First, the developer scooped up onto the developing sleeve 1 by a magnetic pole N1 with the rotation of the developing sleeve 1 has its amount borne on the developing sleeve 1 regulated by the regulating blade 3 in the process of being carried from the magnetic pole N1 to a magnetic pole S1, and is formed as a thin layer on the developing sleeve 1. Here, when the developer formed as the thin layer is carried to the magnetic pole S1 which is a main developing pole, ears are formed by a magnetic force. The above-mentioned electrostatic latent image is developed by the developer formed into the shape of the ears, whereafter the developer on the developing sleeve 1 is returned into the developing container 10 by a repulsive magnetic field by the magnetic pole N1 and a magnetic pole N2 installed on the inner side of the magnet roller 2 which is adjacent to the interior of the developing container 10.

As described above, in the developing apparatus adopting the two-component developing method, magnetic poles of the same polarity are disposed side by side in the magnet 2 in the developing sleeve 1 adjacent to the interior of the developing container 10, whereby the developer after developing is once stripped off from the developing sleeve 1 so as not to leave the previous image hysteresis.

In a developing apparatus using as a developer a two-component developer having a carrier and a toner, it is desirable that the toner and the carrier be agitated well and carried. Again here, there is adopted a two-shaft agitating type in which the interior of the developing container 10 is divided into a developing chamber 4 located on the toner supply side to the photosensitive drum 103 and an agitating chamber 5 side for receiving the supply of the supplied toner, and screw-shaped agitating means 4*a* and 5*a* are disposed parallel with each other in the respective space portions. In the developing apparatus of the two-shaft agitating type, provision is made of the developing sleeve 1, a toner density sensor 6 and a toner container 50 for supply, and a circulation route for agitating and carrying the developer is constituted by the first agitating means 4*a* disposed in the developing chamber 4, and the second agitating means 5*a* disposed in the agitating chamber 5, and the carried developer is fed into and circulated in the respective chambers 4 and 5 from delivery portions formed on the end portion sides of the respective agitating means 4*a* and 5*a*.

FIG. 14B shows the circulation route as it is seen from above. It has the developing sleeve 1 and the screws 4*a* and 5*a* which are the agitating means, and maintains an agitating property and a carrying property.

However, the downsizing of a developing apparatus itself has been required for the downsizing of recent monochromatic/color printers and monochromatic/color copies, and there is the task that a basic function is maintained by a small developing apparatus.

Regarding the downsizing, as a task when the developing apparatus itself is made small, a toner receiving port (supplying port) 8 for receiving (supplying) the toner from a toner supplying container 50 could heretofore be disposed outside the length of the developing sleeve 1 with respect to the lengthwise direction, but it is necessary to dispose the toner receiving port (supplying port) 8 within the length of the developing sleeve 1 in the lengthwise direction thereof. That is, when the developer is carried as shown in FIG. 14B, the toner supplying port 8 could be installed upstream of an area overlapping the developing sleeve 1 in the lengthwise direction thereof with respect to a developer carrying direction, and a distance sufficient for the supplied toner to arrive at the developing sleeve 1 could be kept.

In contrast, when the developing apparatus is downsized, the toner supplying port 8 is installed in an area overlapping the developing sleeve 1 in the lengthwise direction thereof as shown in FIG. 3B of the accompanying drawings, and the supplied toner is not sufficiently agitated, but there cannot be kept a distance at which the developer can be sufficiently agitated before delivered from the second agitating means 5*a* far from the developing sleeve 1 to the first agitating means 4*a* proximate to the developing sleeve 1 and therefore, the chargeability of the supplied toner was bad, and toner spatter, a fogged image and an uneven image occurred.

Herein, screw members are used as the first agitating means and the second agitating means provided in the developing apparatus of the construction as described above, and the first agitating means near to the developing sleeve which is a developer carrying member may be referred to as a first screw, and otherwise referred to herein as screw 5*a*, and the second agitating means far from the developing sleeve may be referred to as a second screw, and otherwise referred to herein as screw 5*b*, wherein the first and second screws are collectively referred to herein as the screws.

The occurrence phenomenon of a faulty image due to the faulty charging of the toner attributable to faulty agitation appeared remarkably after endurance. Also, with the downsizing of the developing apparatus, the carrying screws themselves also became smaller and the agitability and carrying property of the toner were further lowered to thereby make the above-noted problem difficult solve.

SUMMARY OF THE INVENTION

It is an object of the present invention to provide a developing apparatus of which the downsizing is achieved and yet in which a supplied toner can be sufficiently agitated to thereby prevent toner spatter and a faulty image such as a fogged image.

It is another object of the present invention to provide a developing apparatus comprising a first chamber for developing an electrostatic image formed on an image bearing member with a developer including a toner and a carrier, and a second chamber constituting a circulation route for the developer between it and the first chamber, the second chamber having a spiral developer carrying member for carrying the developer, a receiving port for receiving therein the supplied developer including the toner and the carrier, and a discharging port provided downstream of the receiving port with respect to a developer carrying direction for discharging any excess developer therethrough with the supply of the developer, the developer carrying member having a plurality of agitating fins disposed so that the level of the developer near the receiving port may be lower than the level of the developer near the discharging port.

It is still another object of the present invention to provide a developing apparatus comprising a first chamber for developing an electrostatic image formed on an image bearing member with a developer including a toner and a carrier, and a second chamber constituting a circulation route for the developer between it and the first chamber, the second chamber having a spiral developer carrying member for carrying the developer, and a receiving port for receiving the supplied toner therein, the developer carrying member having agitating fins provided in a first area opposed to the receiving port and a second area spaced apart by a predetermined distance and more from the receiving port toward the downstream side thereof with respect to a developer carrying direction so that the level of the developer in the first area may be lower than the level of the developer in the second area.

Further objects of the present invention will become apparent from the following detailed description when read with reference to the accompanying drawings.

DETAILED DESCRIPTION OF THE PREFERRED EMBODIMENTS

A developing apparatus according to the present invention will hereinafter be described in greater detail with reference to the drawings.

First Embodiment

A first embodiment of the present invention will hereinafter be described.

Figure 9:
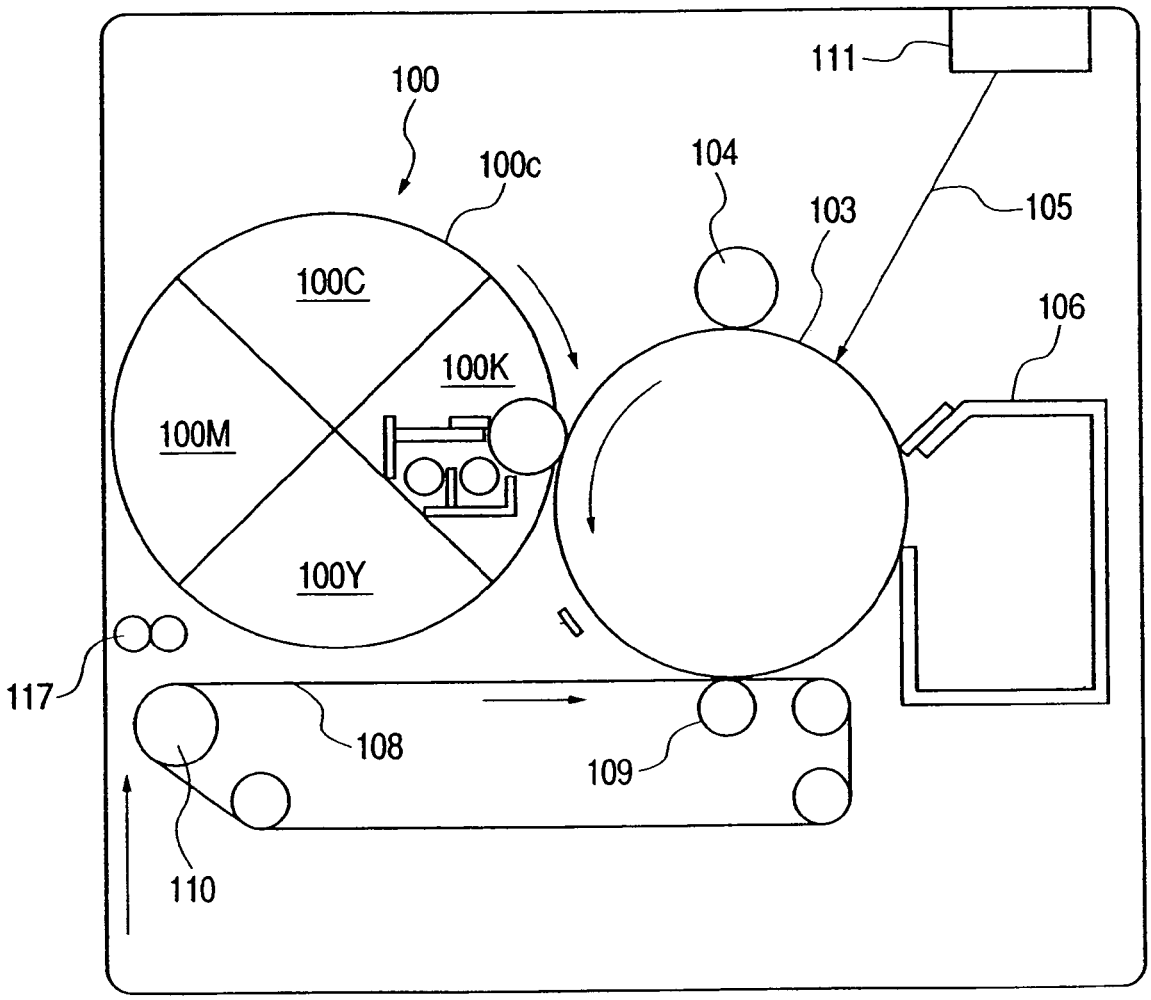
FIG. 9 schematically shows the construction of an embodiment of an image forming apparatus according to the present invention.

FIG. 9 is a typical cross-sectional view schematically showing the construction of an electrophotographic type color printer (hereinafter referred to as the "printer") which is an image forming apparatus according to the present embodiment.

In such a printer, as shown in FIG. 9, there is provided an electrophotographic photosensitive drum 103 (hereinafter referred to as the "photosensitive drum 103") which is an image bearing member rotated in the direction of arrow, and around the photosensitive drum 103, there is disposed image forming means constituted by a charging roller 104, a developing rotary 100*c*, a developing apparatus 100 having four developing devices, a primary transfer roller 109, cleaning means 106, an intermediate transfer belt 108, a secondary transfer roller 110 and a laser beam scanner 111 which is an exposing apparatus, i.e., latent image forming means, disposed above the photosensitive drum 103.

As the developing apparatus 100, developing devices 100M, 100C, 100Y and 100K are provided in the developing rotary 100*c* along the rotational circumference thereof, and each of the developing devices 100M, 100C, 100Y and 100K is adapted to supply a developer (two-component developer) containing toner particles and carrier particles to the surface of the photosensitive drum 103. The developing devices 100M, 100C, 100Y and 100K are adapted to use developers containing a magenta toner, a cyan toner, a yellow toner and a black toner, respectively.

An original to be copied is adapted to be read by an original reading apparatus (not shown). This reading apparatus has a photoelectric conversion element such as a CCD for converting an original image into an electrical signal, and is adapted to output image signals corresponding to the yellow image information, magenta image information, cyan image information and black-and-white image information of the original. A semiconductor laser contained in the scanner LS (laser scanner 111) is controlled correspondingly to these image signals, and applies a laser beam 105.

The sequence of the entire color printer will now be described briefly with the case of a full-color mode as an example.

The surface of the photosensitive drum 103 is first uniformly charged by the charging roller 104. As regards image forming, the photosensitive member is uniformly charged to e.g. −600V by the charging means, whereafter image exposure (laser beam) 105 is done at 600 dpi. The image exposure 105 attenuates the surface potential of an exposing portion to e.g. −200V with the semiconductor laser as a light source to thereby form an image-shaped latent image.

Also, although a scanner portion for reading the image and an image processor portion for preparing image data are not shown, reflected light from the original imaged on the CCD of the scanner portion is A/D-converted into the luminance signal of an image of 600 dpi and 8 bits (256 gradations), and is sent to the image processor portion.

In the image processor portion, well-known luminance-density conversion (log conversion) is effected, whereby the image signal is converted into a density signal, whereafter if necessary, the density signal is passed through filter processing such as edge emphasizing, smoothing or the removal of a high frequency component, whereafter it is subjected to a density correcting process (so-called γ conversion), and then is binarized (1 bit), for example, through a binarizing process such as dither, or a screening process by a dot concentration type dither matrix. Of course, there is also a method of driving a laser by the well-known pulse width modulation (PWM) method or the like while keeping 8 bits to thereby form a latent image.

Thereafter, the image signal is sent to the laser driver of the laser scanner 111 and the laser 105 is driven in conformity with the signal. The laser beam 105 is applied onto the drum 103 through the intermediary of a collimator lens, a polygon scanner, an fθ lens, a turn-back mirror, dust-proof glass, etc. A spot diameter on the drum 103 is a spot size of the order of 55 μm somewhat larger than a pixel of 600 dpi=42.3 μm and is imaged on the drum 103, and eliminates the charges of the image portion to the order of +50V as previously described to thereby form an electrostatic latent image.

Figure 10:
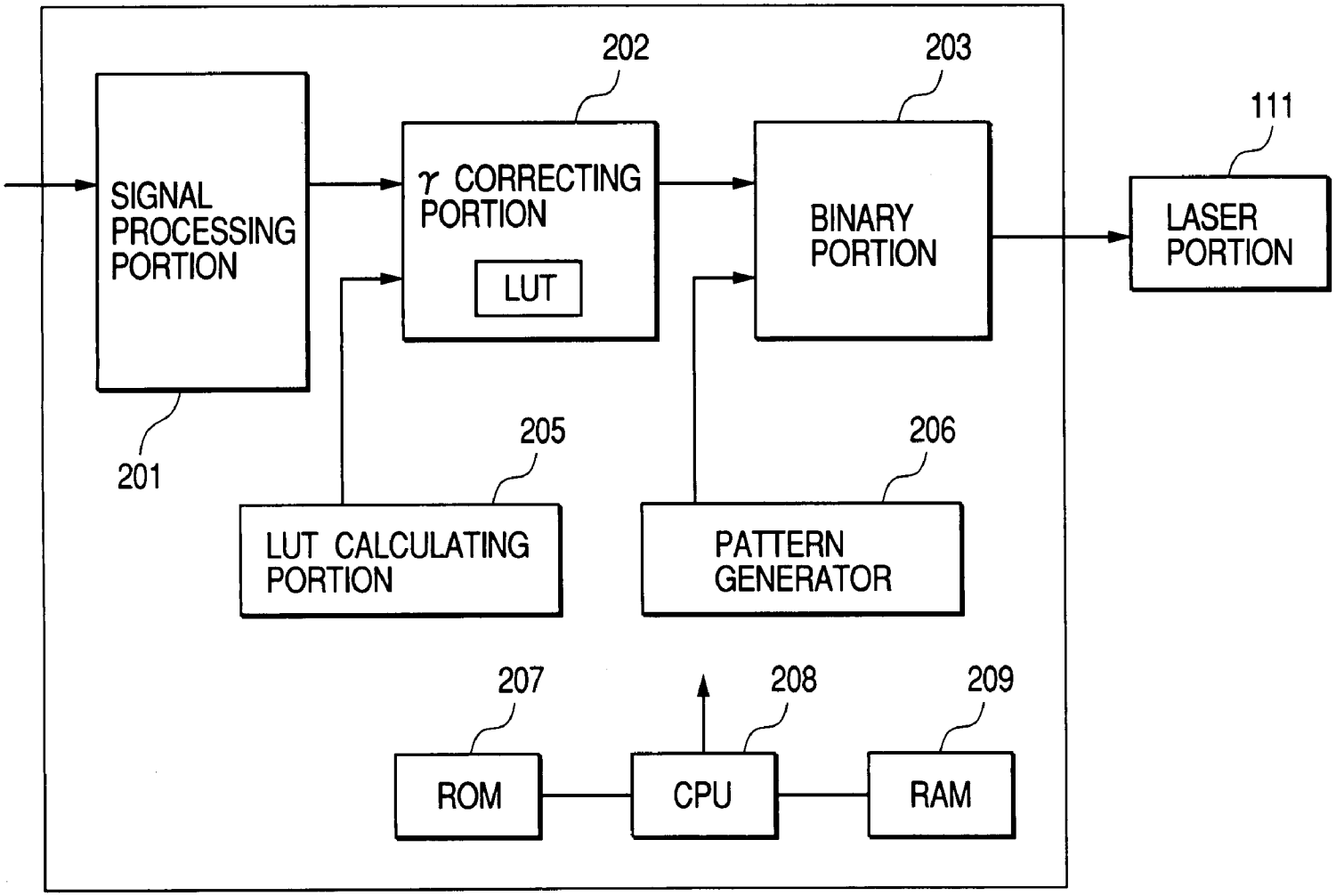
FIG. 10 is a block diagram showing the construction of an image signal controlling portion by an embodiment of the image forming apparatus according to the present invention.

The detailed construction of an image signal controlling portion for controlling the laser 111 for effecting the above-described image exposure. 105 is shown in FIG. 10 and will now be described.

In FIG. 10, in an image processing portion 201, the inputted image signal is subjected to image processing such as resolution conversion desired by an operator. The signal processed in the image processing portion 201 is subjected to γ correction in a γ correcting portion 202 with reference to a look-up table (LUT). Then, in a binary processing portion 203, a driving signal for the laser is produced on the basis of the image signal after γ-corrected. The laser portion 111 for effecting the image exposure 105 corresponding to the image portion is driven on the basis of the driving signal outputted from the binary processing portion 203. In an LUT calculating portion 205, the LUT in the γ correcting portion 202 is newly calculated and renewed so as to become appropriate under the current operation environment. In a pattern generator 206, the image data of a sample pattern is held in advance and is transmitted to the binary processing portion 203.

In a CPU 208, each construction of the image signal controlling portion is generically controlled in accordance with a control program or the like stored in a ROM 207. A RAM 209 is used as the working area of the CPU 208.

Next, the electrostatic latent image subjected to image exposure modulated by a cyan image signal first transmitted by the control of the above-described image signal controlling portion is reversal-developed by the cyan developing device 100C.

On the other hand, the intermediate transfer belt 108 is rotated in the direction of an arrow indicated in FIG. 9 in synchronism with the photosensitive drum 103, and a cyan visualized image developed by the cyan developing device 100C is transferred to a transferring material by a transfer charging device 110 at a transferring portion. The transfer roller 109 intactly continues to be rotated and is prepared for the transfer of an image of the next color (in the present embodiment shown in FIG. 9, magenta).

On the other hand, the photosensitive drum 103 is cleaned by the cleaning means 106, is charged again by the charging roller 104, is subjected to the exposure 105 in the same manner as described above by the laser beam 105 modulated by the next magenta image signal likewise transmitted by the control of the above-described image signal controlling portion, whereby an electrostatic latent image is formed. In the meantime, the developing rotary 100*c* is rotated, and the magenta rotary 100*c* is rotated, and the magenta developing device 100M carried along the rotational circumference thereof is placed at a predetermined developing position, and effects the reversal developing of a dot distribution electrostatic latent image corresponding to magenta to thereby form a magenta visualized image.

Subsequently, the steps as described above are executed on a yellow-image signal and a black image signal, and when the transfer of four-color, visualized images (toner images) is completed, the transferring material transported in the direction of arrow is subjected to transfer and is separated in the secondary transfer roller portion 110, and thereafter is transported to a fixing device 117 by a transport belt. The fixing device 117 fixes the four-color visualized images superposed on the transferring material by heating and pressurizing.

Thus, a series of full-color print sequences are completed, whereby a desired full-color print image is formed.

The construction of the image forming apparatus according to the present embodiment is an example, and for example, the charging device 104 is not restricted to a roller, but may be a charging wire, and various forms such as a transfer belt and a wire are applicable to the transfer roller 109, and basically, as described above, an image is formed by the steps of charging, exposing, developing, transferring and fixing.

The developing apparatus 100 according to the present embodiment installed in the above-described image forming apparatus will now be described with reference to the drawings with the developing device 100K of the four developing devices taken as an example. The constructions of the developing devices 100C, 100Y and 100M differ only in the developers used and are similar to the construction of the developing device 100K and therefore need not be described.

Figure 3A:
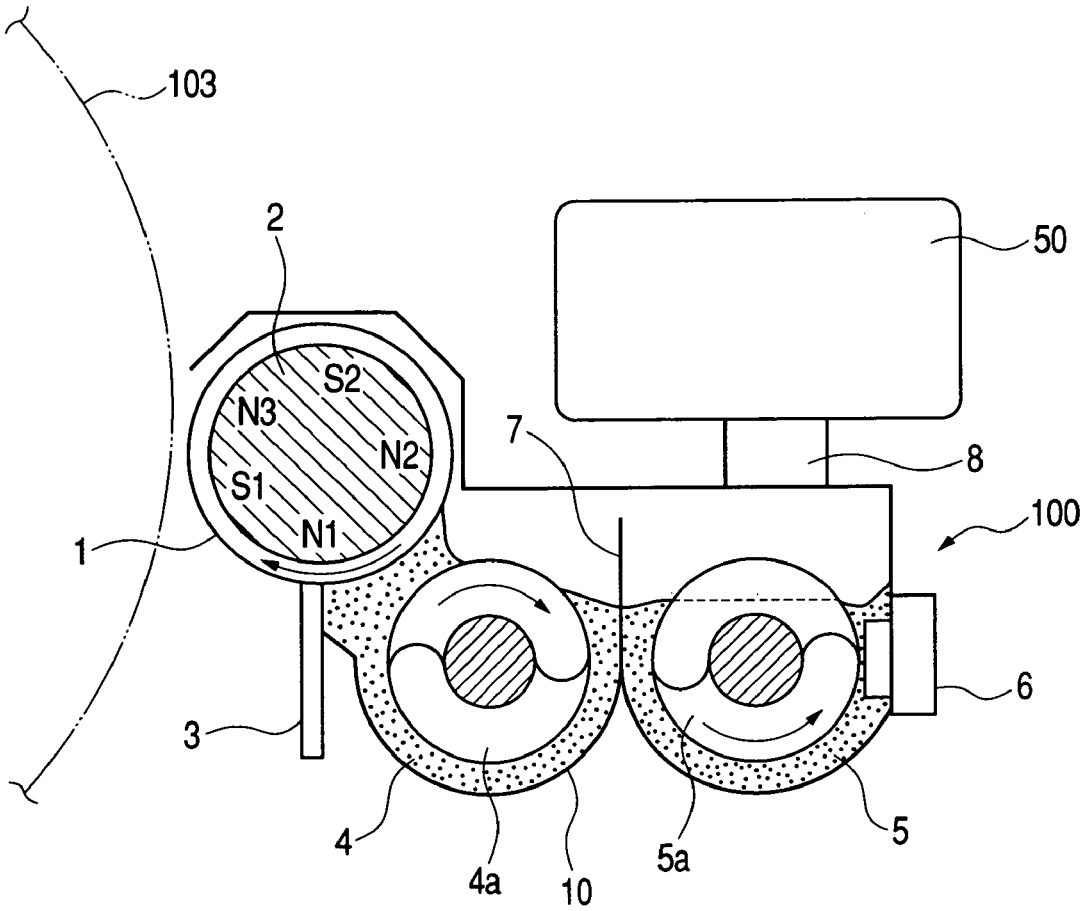
FIG. 3A is a transverse cross-sectional view showing an embodiment of a developing apparatus according to the present invention.
Figure 3B:
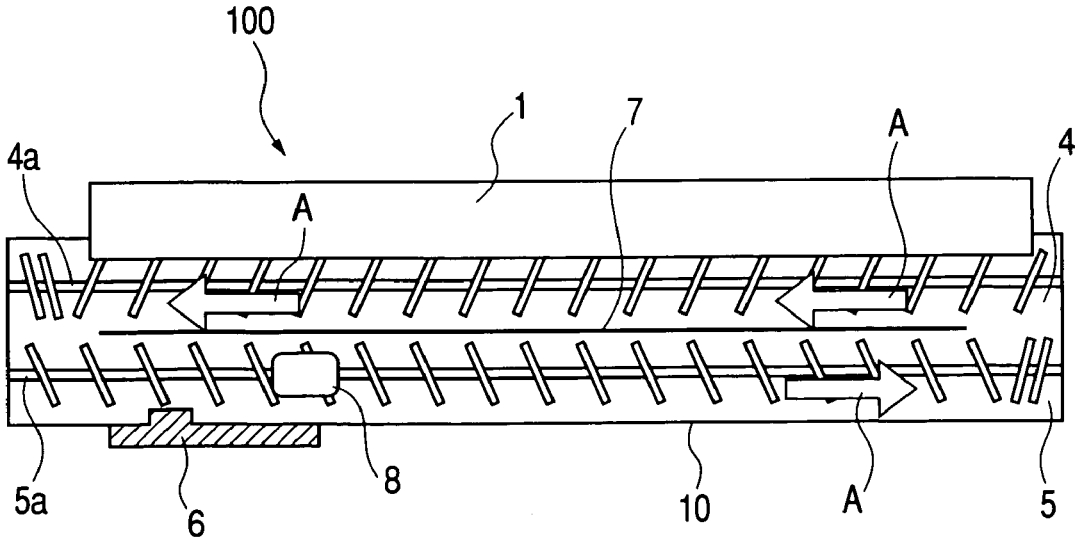
FIG. 3B is a longitudinal cross-sectional view of the developing apparatus shown in FIG. 3A.

FIG. 3A is a cross-sectional view showing the developing device 100K according to the embodiment of the present invention, and is a view of the developing device 100K as it is seen from its back. FIG. 3B is a cross-sectional view of the developing device 100K as it is seen from its upper portion. The developing device 100K is provided with a developing container 10. The developing container 10 contains therein a two-component developer containing a nonmagnetic toner (hereinafter referred to as the "toner") and a magnetic carrier. The developer will be described in detail later.

The interior of the developing container 10 is divided into a developing chamber (first chamber) 4 and an agitating chamber (second chamber) 5 by a partition wall 7, and a toner storing chamber 50 discrete from the developing apparatus 100 is provided above the agitating chamber 5, and a toner to be supplied (nonmagnetic toner) is contained in the toner storing chamber 50. A receiving port (toner supplying port) 8 is provided in the upper portion of the agitating chamber 5 of the developing container 10, and an amount of toner to be supplied corresponding to the consumed toner falls and is supplied into the agitating chamber 5 via the toner supplying port 8. Here, a description will be made of a two-component developing method in this developing apparatus 100.

An opening portion is formed in that region of the developing container 10 which is adjacent to the photosensitive drum 103, and a hollow cylindrical developing sleeve 1 which is a developer carrying member is rotatably incorporated in the vicinity of the opening portion of the developing container 10 so as to protrude from the opening portion.

In the present embodiment, the diameter of the developing sleeve 1 is 20 mm. Also, the developing sleeve 1 is formed of a nonmagnetic material such as SUS305AC, and a magnet 2 which is magnetism generating means is fixedly disposed therein relative to the rotation of the developing sleeve 1.

The magnet 2 fixedly disposed in the developing sleeve 1 relative to the rotation thereof has a magnetic pole S1 which is a developing magnetic pole disposed near a developing area which is the opposed portion of the photosensitive drum 103 and the developing sleeve 1, a magnetic pole N1 which is a first magnetic pole which is a developer layer thickness regulating magnetic pole opposed to a regulating blade 3 which is a developer layer thickness regulating member for regulating the layer thickness of the developing borne on the developing sleeve 1, and magnetic poles N2, S2 and N3 for carrying the developer while causing the developer to be borne on the developing sleeve 1.

Also, the magnet 2 is disposed in the developing sleeve 1 so that the magnetic pole S1 which is the developing magnetic pole may be upstream of the photosensitive drum 103 by 5° with respect to the direction of rotation of the drum 103.

The magnetic pole S1 is adapted to form a magnetic field near the developing portion between the developing sleeve 1 and the photosensitive drum 103, and form a magnetic brush by this magnetic field. In the above-mentioned developing portion, the developer carried in the direction of arrow A indicated in FIG. 3B with the rotation of the developing sleeve 1 contacts with the photosensitive drum 103 and thus, the electrostatic latent image on the photosensitive drum 103 is developed. At this time, in the present embodiment, the developing sleeve 1 an d the photosensitive drum 103 are adapted to be moved in opposite directions at a proximate position (developing portion) to the developing sleeve 1 and the photosensitive drum 103.

The developer which has terminated developing by the magnetic pole S1 is stripped off from the developing sleeve 1 by a repulsive magnetic field formed by the magnetic pole N1 and the magnetic pole N2, and falls into the developing chamber 4.

A vibration bias voltage comprising a DC voltage superimposed on an AC voltage is applied as a developing bias to the developing sleeve 1 by a voltage source. The dark portion potential (non-exposed portion potential) and light portion potential (exposed portion potential) of the latent image on the photosensitive drum 103 are located between the maximum value and minimum value of the above-mentioned vibration bias potential. Thereby, an alternating electric field alternately changing in direction is formed in the developing portion. In this alternating electric field, the toner and the magnetic carrier are vehemently vibrated, and the toner frees itself from the electrostatic restraint to the developing sleeve 1 and the magnetic carrier and an amount of toner corresponding to the potential of the latent image adheres to the photosensitive drum.

Figure 4:
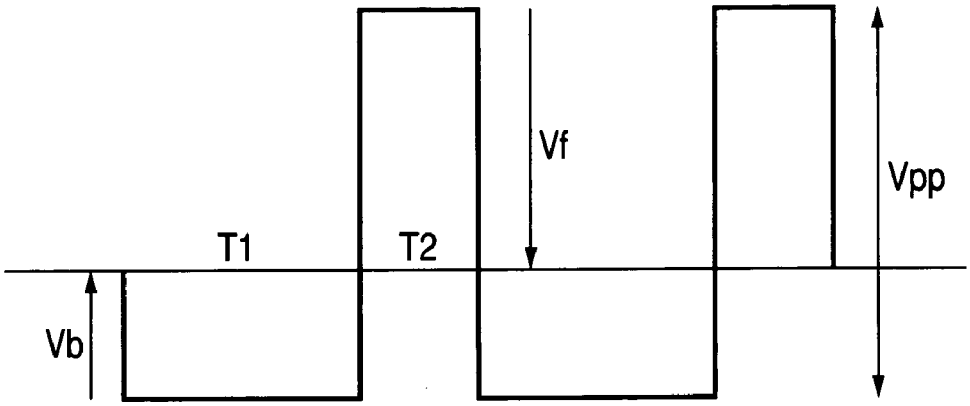
FIG. 4 is an illustration showing a developing bias by an embodiment of the developing apparatus according to the present invention.

In the present embodiment, the dark portion potential of the photosensitive drum 103 is −600V and the light portion potential thereof is −200V, and a DC voltage of −450V is applied as a DC bias to the developing sleeve 1, and an AC voltage of $V_{pp}$=1.8 kV and Frq.=2 kHz is applied as an AC bias to the developing sleeve 1. The duty ratio is 35% on the developing flight side. If as shown in FIG. 4, the vibration bias which is a developing bis is a bias alternately applied to a voltage side of a minimum ordinate value Vb for a time T1 and to a voltage side of a maximum ordinate value Vf for a time T2, T1:T2 becomes 65:35.

Here, a description will be made of the toner used in the present embodiment.

The volume average particle diameter of the toner may suitably be 4–10 μm. Here, as the volume average particle diameter of the toner, use is made, for example, of one measured the following measuring method.

In the measuring method used here, as a measuring apparatus, use is made of a Coulter counter TA-II type (manufactured by Colter K.K.), and an interface (manufactured by Nikkaki K.K.) and CX-i personal computer (manufactured by Canon Inc.) which output a number average distribution and a volume average distribution are connected thereto, and first class sodium chloride is used as electrolyte to prepare 1% NaCl water solution. As the measuring method, 0.1–5 ml of interfacial active agent (preferably alkyl benzene salt sulfonate) as a dispersing agent is added to 100–150 ml of the electrolytic water solution, and 0.5–50 mg of measurement sample if further added thereto. The electrolyte in which the sample is suspended is subjected to a dispersing process by an ultrasonic dispersing device for about one to three minutes, and by the above-mentioned Coulter counter TA-II type, the particle size distribution of 2–40 μm of particles is measured by the use of 100 μm aperture as an aperture to thereby obtain a volume distribution. From the thus obtained volume distribution, the volume average particle diameter of the sample is obtained.

The surface of the toner as described above is further covered with an extraneous additive, whereby there are two effects in terms of software. One of them is that fluidity is improved and it becomes easy for the supplied toner to be mixed and agitated with the two-component developer in the developing container 10, and the other effect is that the extraneous additive intervenes on the surface of the toner, whereby the mold releasing ability of the toner used for developing on the photosensitive drum 103 relative to the photosensitive drum 103 is increased and transfer efficiency becomes good.

It is preferable from the viewpoint of durability when added to the toner that the extraneous additive used in the present invention have a particle diameter equal to or less than 1/10, in contrast with the weight average diameter of the toner particles. This particle diameter of the extraneous additive means the average particle diameter of the toner particles obtained by the surface observation thereof in an electronic microscope.

As the extraneous additive, use is made, for example, of a metal oxide (such as aluminum oxide, titanium oxide, strontium titanate, cerium oxide, magnesium oxide, chromium oxide, tin oxide or zinc oxide), a nitride (such as silicon nitride), a carbide (such as silicon carbide), metallic salt (such as calcium sulfate, barium sulfate or calcium carbonate), fatty acid metallic salt (such as zinc stearate or calcium stearate), carbon black, silica or the like.

0.01–1.0 parts by weight, and preferably 0.05–5 parts by weight of extraneous additive are used relative to 100 parts by weight of toner particles. A single extraneous additive or a plurality of extraneous additives may be used. Preferably they maybe subjected to hydrophobic treatment. In the present embodiment, use is made of titanium oxide having an average particle diameter of 20 nm extraneously added.

The magnetic carrier is obtained by particle-diameter selecting particles obtained making the particles of a metal such as iron, chromium, nickel or cobalt as in the conventional magnetic carrier as a magnetic material, or a compound or an alloy thereof, for example, a ferromagnetic material such as triiron tetroxide, γ second iron monoxide, chromium dioxide, manganese oxide, ferrite or manganese-copper alloy spherical, or spherically covering the surfaces of the particles of those magnetic materials with resin such as styrene resin,. vinyl resin, ethyl resin, rosin modified resin, acrylic resin, polyamide resin epoxy resin or polyester resin, or fatty acid wax such as palmitic acid or stearic acid, or making spherical particles of resin or fatty acid wax containing dispersed fine particles of a magnetic material, by conventional average particles diameter selecting means.

In the present embodiment, use was made of a magnetic carrier consisting of 70 wt % of fine particulate ferrite dispersed in resin and having a weight average particle diameter of 35 μm, a value of magnetization of 50 $Am^2/kg$ at 100 mT, and resistivity of $10^{14}$ Ωcm or greater, and subjected to spherical processing by heat, and as the toner, use was made of weight ration 1% of titanium oxide having an average particle diameter of 20 nm extraneously added to nonmagnetic particles obtained by a crushing granulation method and including 100 parts by weight of styrene acryl resin (HIMER up 110 manufactured by Sanyo Chemical Industries, Ltd.), 10 parts by weight of carbon black (MA-100 manufactured by Mitsubishi Kasei K.K.) and 5 parts by weight of nigrosine, and having a weight average particle diameter of 5 μm, and developing was effected under a condition that the toner percentage of the developer in a developer reservoir was 8 wt % to the carrier. The average charge amount of the toner was 20 μC/g. In the present embodiment, the magnetic carrier may preferably have a weight average particle diameter of 20–60 μm, and more preferably of 20–50 μm.

In the above-described developing apparatus 100, the characteristic portion of the present invention will now be described.

In the developing container 10, screw 4*a* which is first agitating means is disposed substantially parallel to the developing sleeve in the developing chamber 4 near to the developing sleeve 1, and screw 5*a* which is second agitating means is disposed in the agitating chamber 5 far from the developing sleeve 1. The developer is carried and agitated by the screw 4*a* and the screw 5*a*, and is circulated in the developing container 10. A partition wall 7 capable of communicating with the developing chamber 4 and the agitating chamber 5 by the end portions thereof is provided between the screw 4*a* and the screw 5*a*.

A description will be made with reference to FIG. 3B. As shown in FIG. 3B, the screw 4*a* and the screw 5*a* are disposed substantially parallel with each other, and the space therebetween is partitioned by the partition wall 7 so that the developer may not go between the screw 4*a* and the screw 5*a*. The partition wall 7 is absent in the lengthwisely opposite end portions of the space so that the developer can go between the screw 4*a* and the screw 5*a*. Since the screw 4*a* and the screw 5*a* are adapted to carry the developer in opposite directions, such a circulation route along which the developer incessantly goes round is formed in the developing container 10.

Also, a toner density sensor 6 is provided on a wall surface rearward of the screw 5*a*, i.e., on the upstream side with respect to a developer carrying direction. As the toner density sensor 6, in the present embodiment, use is made of one adopting a toner detecting method of an inductance detection type for detecting changes in the apparent permeability of the toner and the carrier. Consequently, if the developer stagnates on the surface of the sensor, the sensor becomes incapable of accurately detecting the toner density of the developer and therefore, this toner density sensor 6 has its sensor surface disposed so as to be perpendicular to the developer level near the screw 5*a* so that the developer may not stagnate on the sensor surface. The toner density is the mixing ration between the carrier and the toner, and is what is called the T/D ratio.

The reason why as described above, in the agitating chamber 5, the toner density sensor 6 is provided on the upstream side of the screw 5*a* with respect to the developer carrying direction is that when the toner is used for image forming and the toner density of the developer drops, the toner density is immediately detected.

Thus, the developer present on the screw 4*a* side and used for image forming is sent to the screw 5*a* side by the aforedescribed circulation, and the toner density thereof is detected by the toner density sensor 6. Then, on the basis of the result of the detection, a proper amount of toner is supplied from a toner supplying mechanism through the toner supplying port 8 provided downstream of the toner density sensor 6, whereby the toner density of the developer is always kept constant.

At this time, in order to enable the developer to be favorably agitated and carried to thereby accomplish better image forming, firstly, it is necessary that if FIG. 3A, the height of the surface of the developer on the screw 4*a* side which is the developing chamber 4, i.e., the developer height (hereinafter referred to as the "developer level"), be maintained at a predetermined height.

If this developer level is too low, the amount of developer carried from the screw 4*a* is too small as a whole amount, whereby the amount by which the developer supplied to the developing sleeve 1 stagnates in the regulating portion of the regulating blade 3 is decreased, and this becomes liable to cause uneven supply from the screw 4*a* in this portion. More specifically, the screw 4*a* becomes liable to cause the uneven supply of the developer. As a result, a so-called uneven screw pitch which causes uneven density to an image by a screw pitch occurs.

If conversely, the developer level is too high and the developer completely covers that portion of the developing sleeve 1 from which the developer is stripped off, the stripped-off developer is held down by the covering developer and is returned onto the developing sleeve 1. In that case, the stripping-off of the developer takes place relatively well near the screw vane of the screw 4*a*, whereas in the other portions, the developer is not stripped off and therefore, there is caused the occurrence of the uneven screw pitch during the printing of a solid image. Accordingly, it is desirable that the developer level be such a height as will not completely cover the space between repulsive poles, but will sufficiently cover the regulating portion of the regulating blade 3.

Secondly, it is preferable that the developer level on the screw 5*a* side be at a position lower than the uppermost portion of the vane 5*c* (FIG. 1A) of the screw 5*a*.

This is because the screw 5*a* side has the purpose of mixing and agitating the supplied fresh toner and the developer in the developing container 10, and if the developer level becomes higher than the screw 5*a*, the developer present at a position higher than the screw 5*a* is difficult to agitate. Particularly, if the developer level is at a position higher than the screw 5*a* when toner supply is effected, the toner smaller in specific gravity than the developer may sometimes remain floating on the developer level. If so, the supplied toner will not readily mix with the developer already being in the developing chamber 5, and almost uncharged toner will be supplied to the developing sleeve 1 side, and such a problem as fog or faulty density will arise.

Figure 8A:
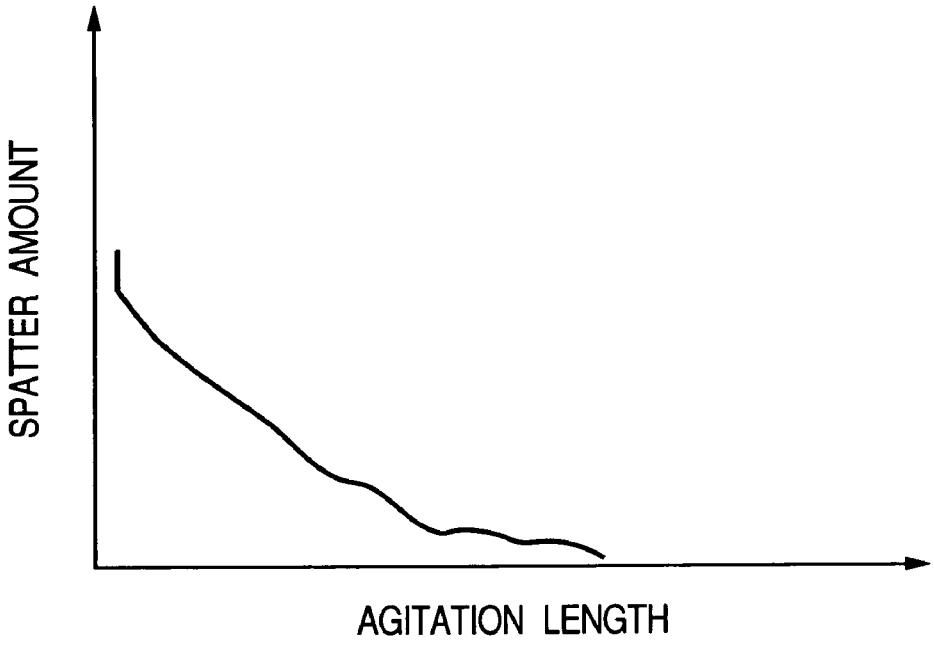
FIG. 8A is a graph showing the relation between an agitation length and a toner spatter amount.
Figure 8B:
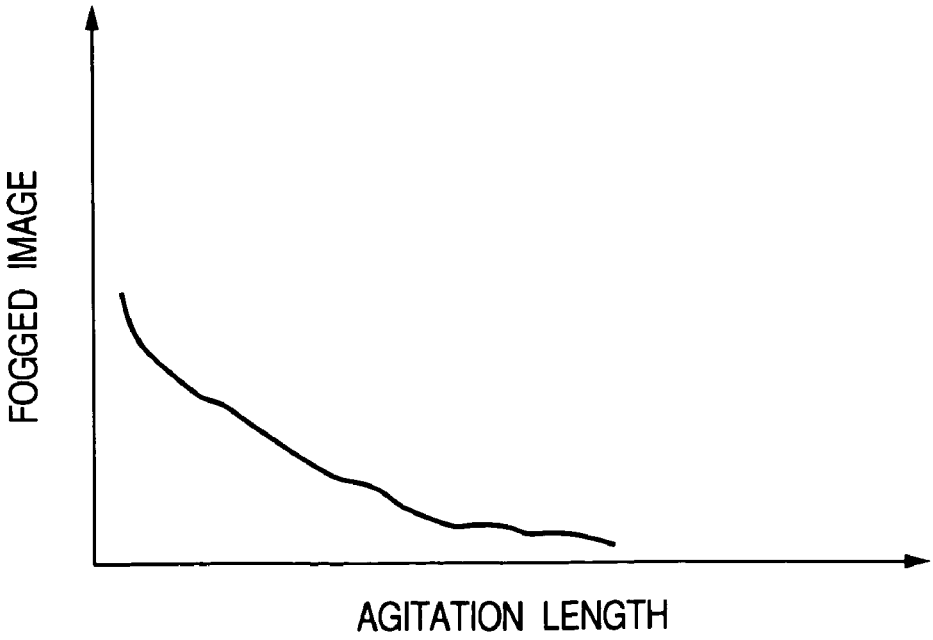
FIG. 8B is a graph showing the relation between the agitation length and a fogged image.

FIG. 8A qualitatively shows the relation between the agitation length and spattering toner, and FIG. 8B qualitatively shows the relation between the agitation length and a fogged image. The agitation length in the outermost diameter of the screw 4*a* or screw 5*a* within the rotation range thereof.

As shown, the shorter is the agitation length, the worse become both spatter and fogging. By the downsizing of the developing apparatus 100, this agitation length becomes shorter and shorter, and the allowable amount of spatter and fog is exceeded.

Figure 7A:
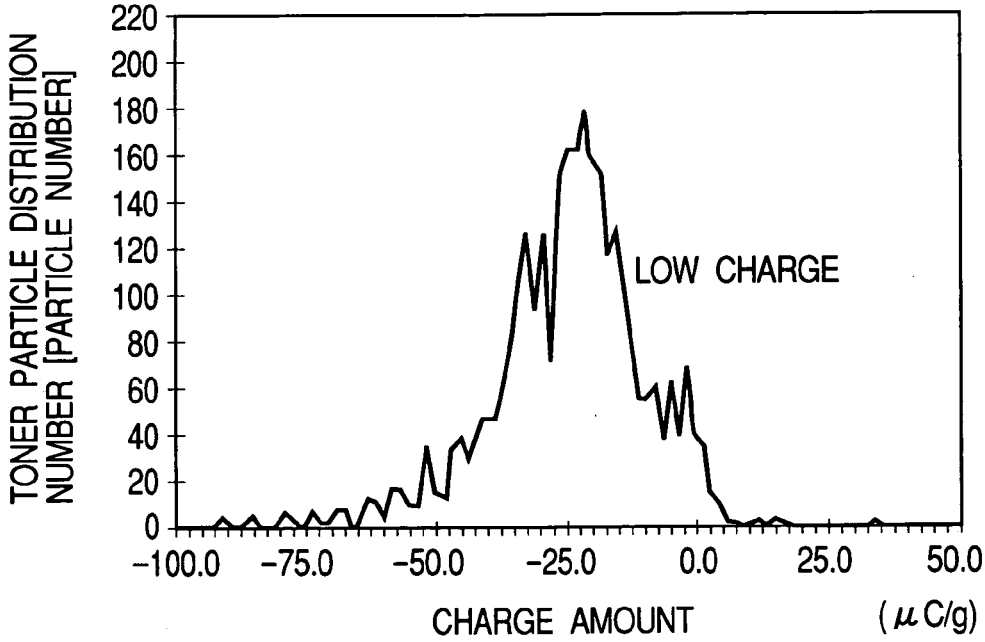
FIG. 7A is a graph showing an example of a toner charge amount distribution in the developing container according to the present invention.

Here, the charge impart ability of the toner will be described with reference to FIG. 7A. FIG. 7A represents a toner charge amount distribution to a toner particle distribution contained in the developing apparatus 100 of the construction shown in FIGS. 3A and 3B. In FIG. 7A, the axis of ordinates represents the toner particle distribution number, and the axis of abscissas represents the charge amount, and the right side is plus and the left side is minus. The broken line indicates the charge amount distribution of the toner after endurance, and the solid line indicates the initial charge amount distribution. A portion for delivering the developer from the screw 5*a* to the screw 4*a* is defined as a measuring point.

Figure 7B:
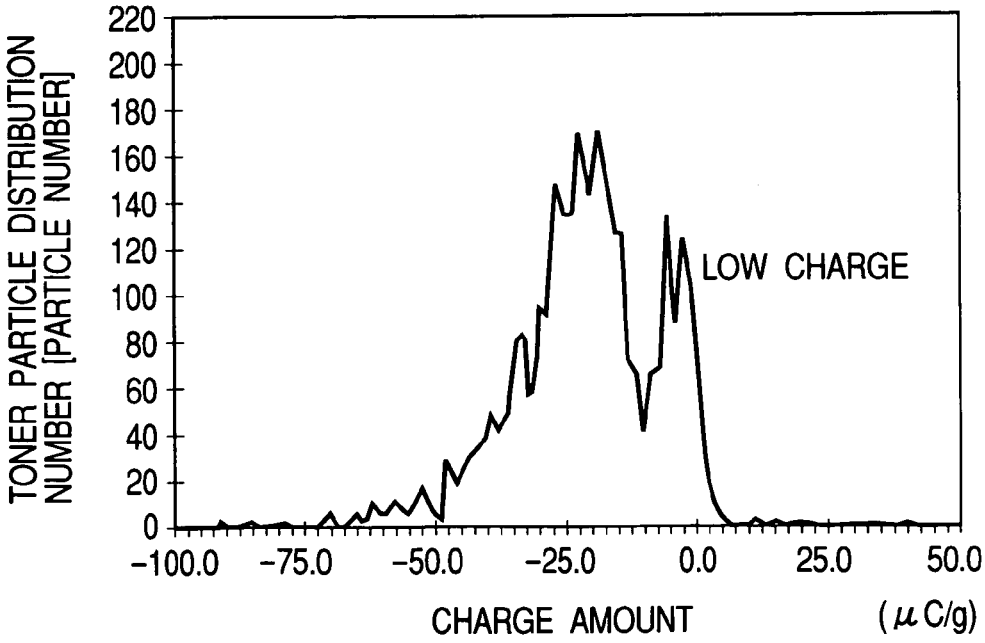
FIG. 7B is a graph showing a comparative example of the toner charge amount distribution in the developing container.

FIG. 7B shows the toner charge amount distribution of the toner contained in a two-component developing apparatus of the conventional two-shaft agitating type. The toner in this case is of the negative polarity and therefore, the minus side from 0 is preferable. However, it will be seen that there are two peaks, one of which is in the vicinity of 0. That is, it follows that there is much toner insufficiently charged. That is, charge is not sufficiently imparted to the toner and therefore, the above-mentioned spatter and fogging occur.

The present embodiment proposes to solve these problems by the following constructions (1) and (2), particularly by the construction (2).

(1) First, in the present embodiment, the screw 4*a* pitch was 15 mm and the screw 5*a* pitch was 24 mm, and the developer level on the screw 4*a* side was made proper. That is, the screw 4*a* pitch was made narrower than the screw 5*a* pitch and the agitating property was made low. At this time, the screw diameter was 18 mm for both of the screw 4*a* and the screw 4*b*, and the screw shaft diameter was 8 mm.

Figure 1A:
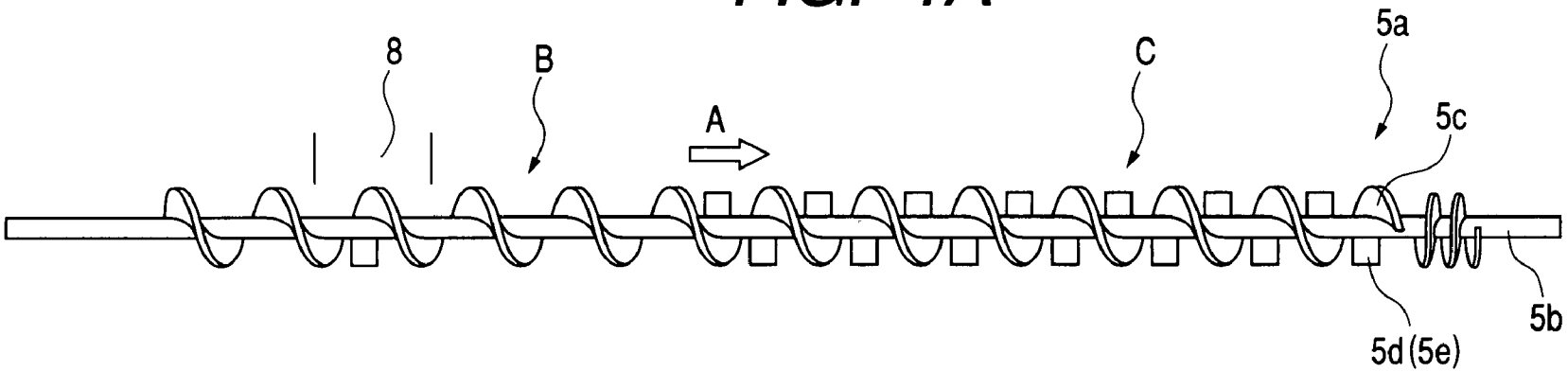
FIG. 1A is a front view showing an example of second agitating means according to the present invention.
Figure 2B:
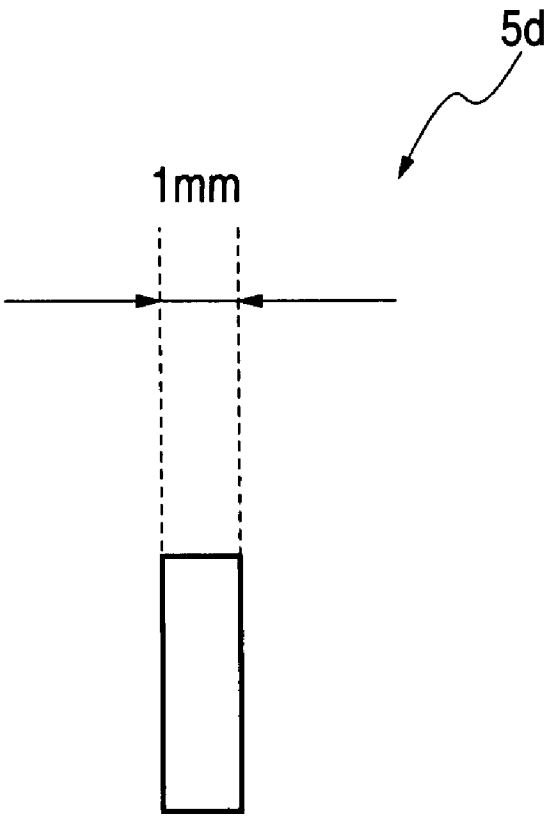
FIG. 2B is a cross-sectional view of the fin member shown in FIG. 2A.
Figure 2A:
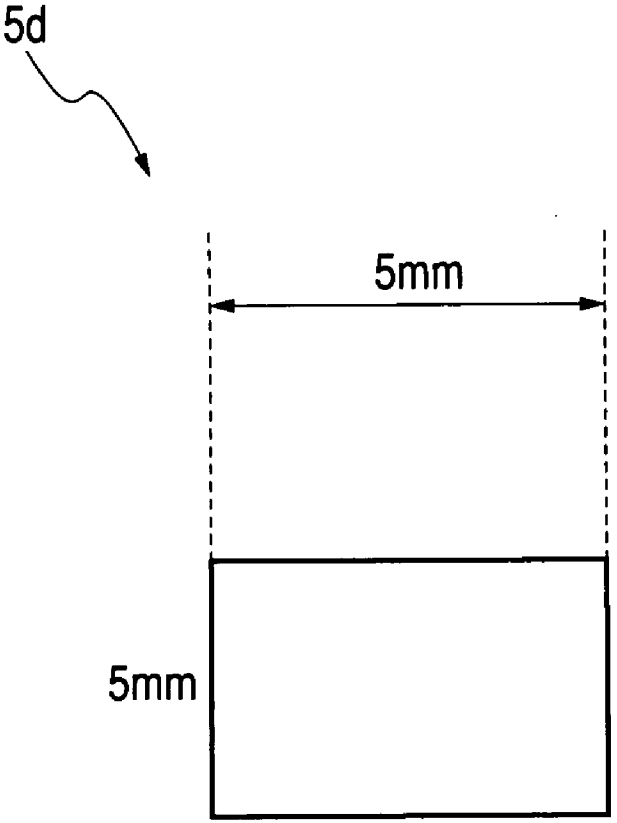
FIG. 2A is a front view showing an example of a fin member according to the present invention.

(2) As the shape of the screw, the screw 5*a* was made into a construction as shown in FIG. 1A which is provided with a first area B which is fin-free portion having fins 5*d* which are plate-like members provided among the mounting portions of an agitating vane 5*c* not mounted on a screw shaft 5*b*, and a second area C (which is a finned portion provided with more plate-like members (fins) 5*d* radially on the circumference of the screw shaft 5*b*, than in the first area B, here, provided with twenty fins along the lengthwise direction of the screw shaft 5*b* in four directions. That is, the screw 5*a*, when viewed from the center of the shaft, was made into a construction provided with four fins 5*d*. And yet, the screw 4*a* was made into a shape free of fins. The shape of the fin 5*d*, as shown in the front view of FIG. 2A and FIG. 2B which is a view of a fin as it is seen from the thickness direction thereof, was made to have a width of 5 mm, a length of 5 mm from the screw shaft, and a thickness of 1 mm.

Figure 5:
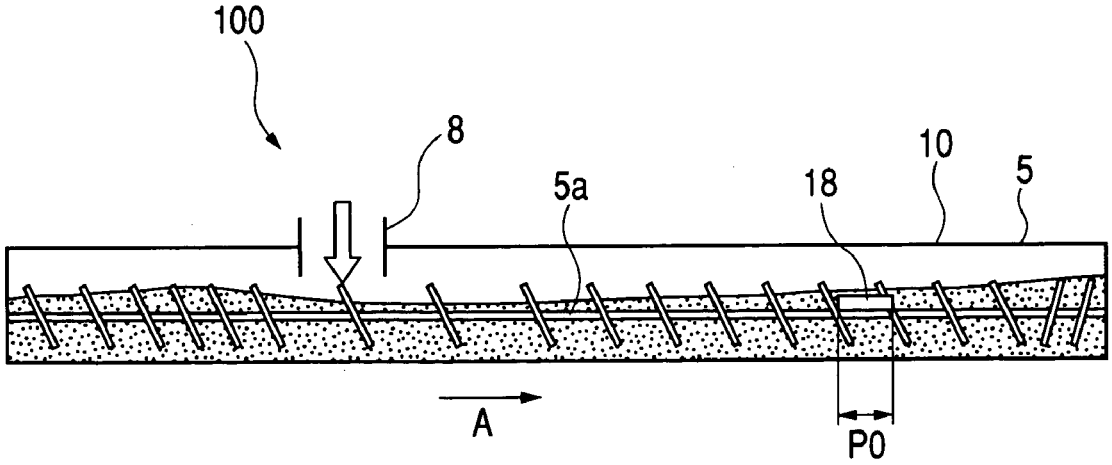
FIG. 5 is a lengthwise transverse cross-sectional view showing an embodiment of the developing apparatus according to the present invention.

Next, FIG. 5 shows the developer level of the screw 5*a* in a conventional construction. FIG. 5 is a cross-sectional view of the developing apparatus 100 as it is seen from the side opposite to the developing sleeve 1, and the developer goes toward the side of arrow A. The toner is supplied from the toner supplying port 8.

Figure 6A:
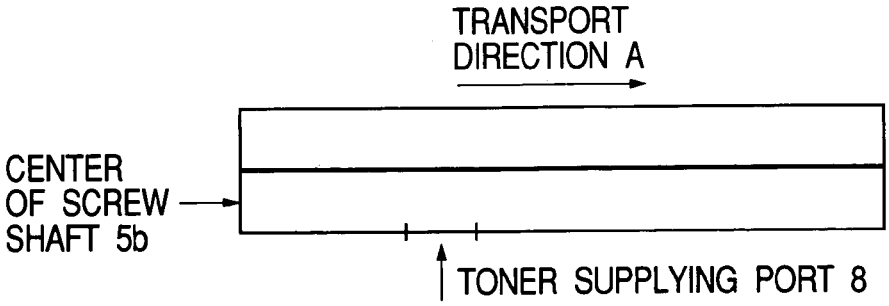
FIGS. 6A, 6B, 6C and 6D are illustrations illustrating the levels of a developer in a developing container according to the present invention.
Figure 6B:
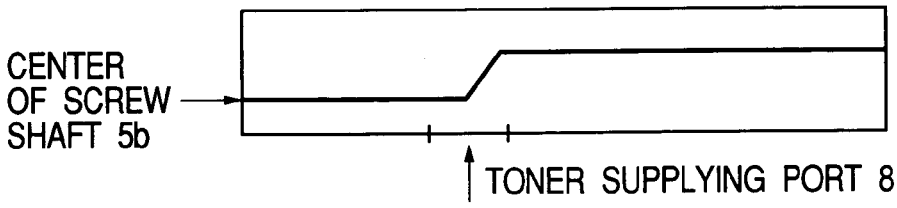
Figure 6C:
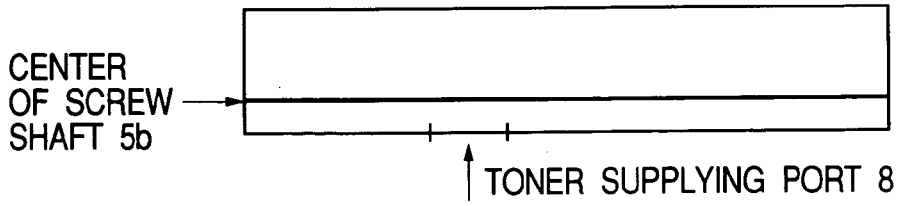

Here, in FIGS. 6A to 6D, FIG. 5 is simplified and the developer level is typically shown. Regarding the developer level, it has heretofore been considered that it is generally better for the developer level in the agitating chamber 5 to be made substantially horizontal. So, the pitches of the screw 4*a* and the screw 5*a* were changed or the number of revolutions thereof was changed to thereby change the balance of circulation and adjust the developer level and as a result, before agitation, the horizontal developer level as shown in FIG. 6A was lowered as shown in FIG. 6C to improve the agitatability, thereby improving the agitatability and chargeability, but the agitation length was short, and this was insufficient. Specifically, when in the endurance of 10 k (i.e., 10×1000 sheets), solid images were taken, fogged images were 5% to an allowable value 2%. Usually, in solid image copies, a great amount of toner enters the developing container 10 and therefore, agitation is most severe.

In the present case, in the first area near the supplying port 8 and downstream with respect to the developer carrying direction, as shown in FIG. 1A, a screw dropped in its agitating and carrying property was used as the screw 5*a* to thereby lower the height of the developer level in the toner supplying port 8 portion, and introduce the supplied toner about the agitating screw shaft 5*b*, and also the screw shaft 5*b* was radially provided with the agitating fins 5*d* in order to agitate the developer at maximum in the downstream portion with respect to the carrying direction, thereby improving agitatability and charge impartability.

A state in which the screw 5*a* has been rotated in this state is the position of the toner supplying port 8 at which the toner supplying port 8 is present, and the downstream portion thereof with respect to the developer carrying direction is the developer level shown in FIG. 6B which becomes higher than in the upstream portion. Thus, a level difference is caused between the toner supplying port 8 and the downstream side thereof. The screw becomes a functionally separate type agitating screw in which the upstream side of this level difference functions to introduce the toner and the downstream side of the level difference functions to agitate up. As a result, fog in image becomes markedly good, i.e., 1% even after ten sheets of solid images after endurance of 10 k. Actual images caused no unevenness in the lengthwise direction, and uniform images could be formed.

As the reason for this, when actually the charge amount distribution of the toner is measured, the peak of the charge amount 0 is low as shown in FIG. 7A, and both at the initial stage and after endurance, the uncharged toner can be decreased.

Figure 1B:
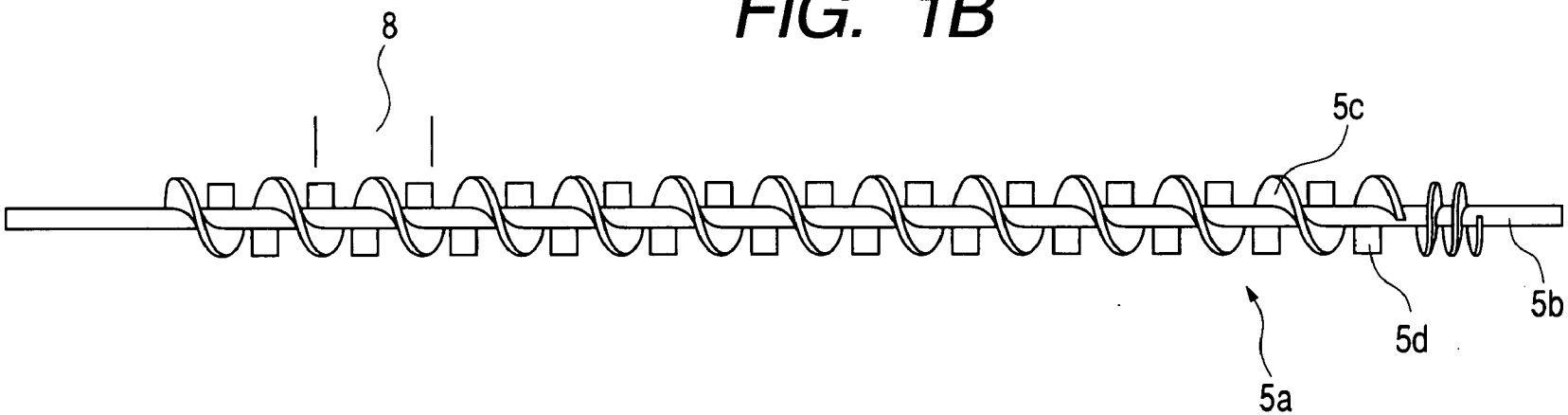
FIG. 1B is a front view showing a comparative example.
Figure 6D:
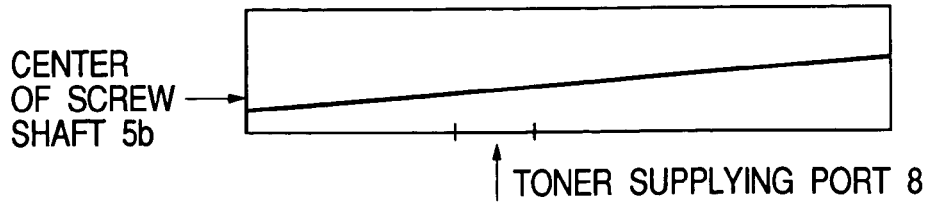

As a comparative example, even if as a similar construction, the pitches of the screw 4*a* and the screw 5*a* were adjusted so that the developer level might become a developer level shown in FIG. 6D wherein the developer level does not rise at the position of the toner supplying port 8, but gradually rises without any level difference toward the downstream side with respect to the developer carrying direction, it was insufficient and fog was 4.5%, and this did not differ from a case where the developer level was not proper. Regarding the shape of the screws, even in a case as shown in FIG. 1B wherein fins were provided on the whole, fog was worse, i.e., 6.2%. It is because the shape of the developer level becomes similar to the shape of the developer level before agitation corresponding to FIG. 6A, and in this case, the supplied developer does not enter the developer, but creeps on the upper surface of the developer level and flows toward the downstream side.

The developer level will now be described. In the present embodiment, the distance between the screws 4*a*, 5*a* and the bottom surface of the developing container 10 is 1 mm and therefore, the actual height of the developer level right beneath the toner supplying port 8 portion was 13 mm from the bottom surface of the developing container 10. In contrast, the distance was 19 mm on the downstream side. The difference between the two is 6 mm.

Such height of the developer level can be changed by the predetermined distance of the first area of the downstream portion of the toner supplying port 8 which is not provided with the fins 5*d*. For agitatability, it is important to introduce all of the toner into the interior of the screw 5*a*, and it is preferable that the developer level be lower from the shaft 5*b* by a half of the radius of the screw 5*a*. In that point, it is preferable to secure the predetermined distance of the fin-free portion B corresponding to at least two pitches of the screw. In the present embodiment, the predetermined distance was an amount corresponding to three pitches.

Next, the number of fins 5*d* in the second area must be greater than that in the first area near the toner supplying port 8, but when the fins are to be radially provided with respect to the screw shaft 5*b*, it is preferable that when the center of the shaft 5*b* is seen from above it, at least three fins be provided per pitch. Thus, a fin is provided at each 120 degrees. In the present embodiment, as previously described, four fins were provided at each 90 degrees.

Regarding the introduction of the toner, in the present embodiment, a fin was provided just beneath the toner supplying port 8 to thereby stabilize the introduction. The prevision of a number of fins 5*d* is not suitable because the developer level rises, and it is preferable to provide two or less fins just beneath the toner supplying port 8. By adopting the above-described construction, fogged images could be suppressed to 1.2% or less at maximum even under 50 k (50×1000 sheets) endurance and low-humidity and high-humidity environments.

As described above, in a compact two-component developing apparatus, the faulty agitation of the toner could be prevented, and the chargeability and agitatability of the toner could be maintained to thereby prevent spatter and fogging, and provide images of high quality free of image unevenness even in endurance.

Second Embodiment

Figure 11:
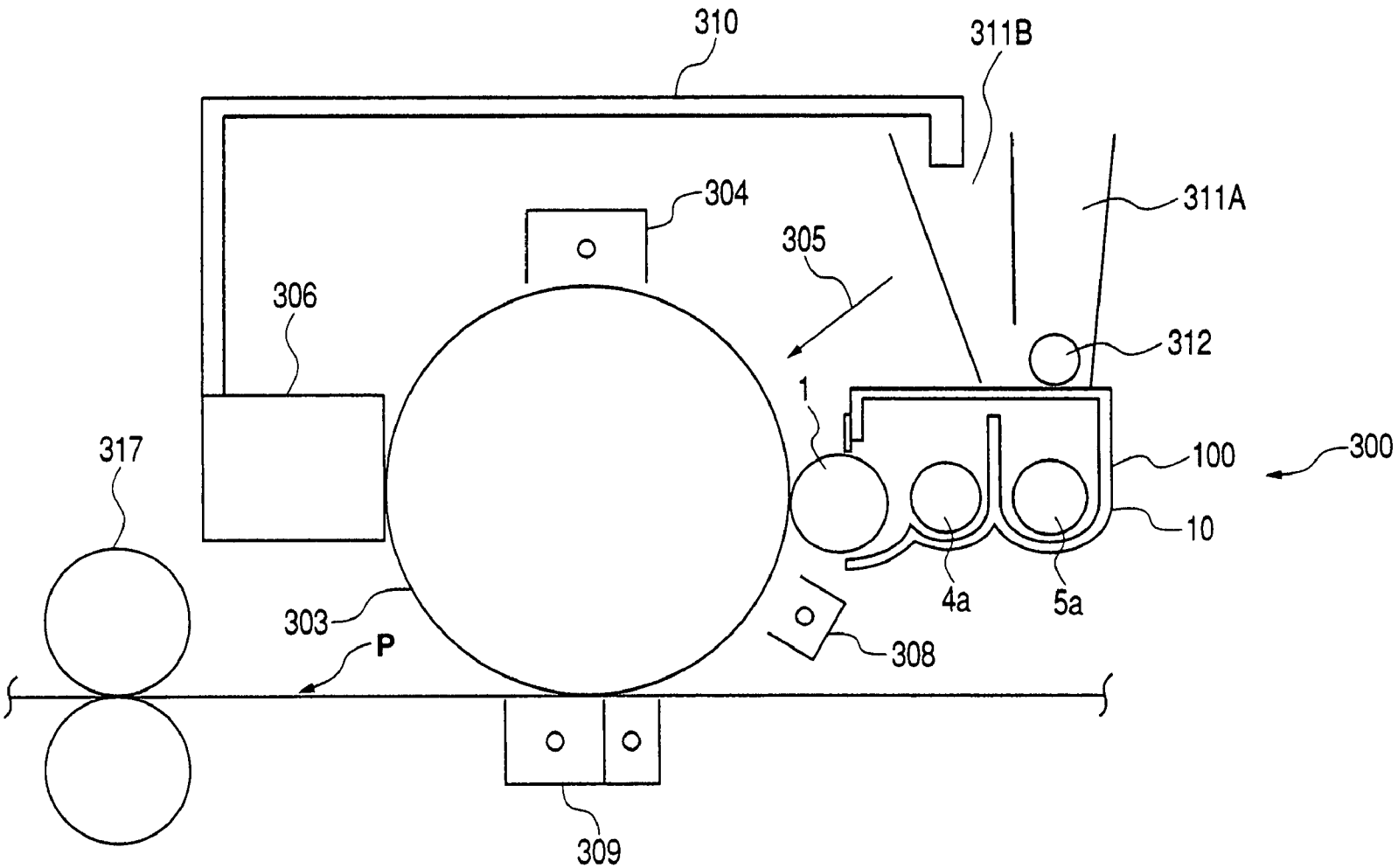
FIG. 11 schematically shows the construction of another embodiment of the image forming apparatus according to the present invention.

The feature of this embodiment is that the developing apparatus 100 of the present invention is applied to a reuse image forming apparatus 300 of a construction shown in FIG. 11. A reuse system toner is basically a waste toner not transferred but remaining and collected by cleaning and therefore, is deteriorated and as compared with a new toner, it is extremely small in triboelectrification and therefore includes a great amount of reversal component toner and thus, becomes still worse in charging stability. The waste toner is high in degree of agglutination and therefore, the mechanical share of the toner increases further. The present embodiment was carried out in view of these problems.

In the present embodiment, a description will be made of a digital copying machine using an OPC drum as a photosensitive drum 303 which is an image bearing member in an image forming system shown in FIG. 11. The process speed is 110 sheets/mm. of 500 mm/s. The surface of this photosensitive drum 303 is uniformly charged to −700V by a primary charging device 304. Then, exposure 305 by PWM is effected at 600 dpi by a semiconductor laser (not shown) of a wavelength 680 μm to thereby form an electrostatic latent image on the photosensitive drum 303. Next, the electrostatic latent image is reversal-developed by the developing apparatus 100 and is visualized as a toner image. The developer effects two-component developing, and effects reversal developing using a negative toner. The particle diameter of the toner is 8.0 μm. As a developing bias, a bias voltage comprising a DC voltage of +200V superimposed on an AC voltage of a frequency 2400 Hz, AC voltage 1500 $V_{pp}$ and duty 50% is applied. S-Bgap was 350 μm, and S-Dgap was 350 μm. Thereafter, a total current −200 μA is supplied by a post-charging device 308 to thereby charge the toner image, whereafter the toner image is transferred to a transferring material P travelling in the direction of arrow by a transfer charging device 309, and the transferring material P is sent to a fixing device 317 to thereby fix the toner image thereon.

On the other hand, any untransferred toner on the photosensitive drum 303 is removed and collected by a cleaning apparatus 306, and the waste toner (reuse toner) is returned to a developing hopper 311B through a carrying pipe 310. A screw-shaped carrying member (not shown) is contained in the transport pipe 310, and is rotated to thereby carry the reuse toner. Describing in greater detail, as shown in FIG. 11, the carried reuse toner is put into the developing hopper 311B for reuse. Also, the new toner is discretely put into a hopper 311A, and a supplying roller 312 is rotated, whereby the toner is carried into the developing apparatus 100.

In the present embodiment, a method of mixing the reuse toner and the new toner with each other in the developing apparatus 100 is adopted, but a space for mixing may be provided in the hopper 311A or 311B to thereby mix the reuse toner and the new toner with each other. The toners mixed together in the developing apparatus 100 are again sent to the developing sleeve 1 and are used for developing on the photosensitive drum 303. The normal rotating speed of the supplying roller 312 of the hopper 311A is 2 rotations/min. and the rotating speed of the roller is changed. As regards the supply amount, the rotation of the roller is controlled by image data (video count).

Figure 12B:
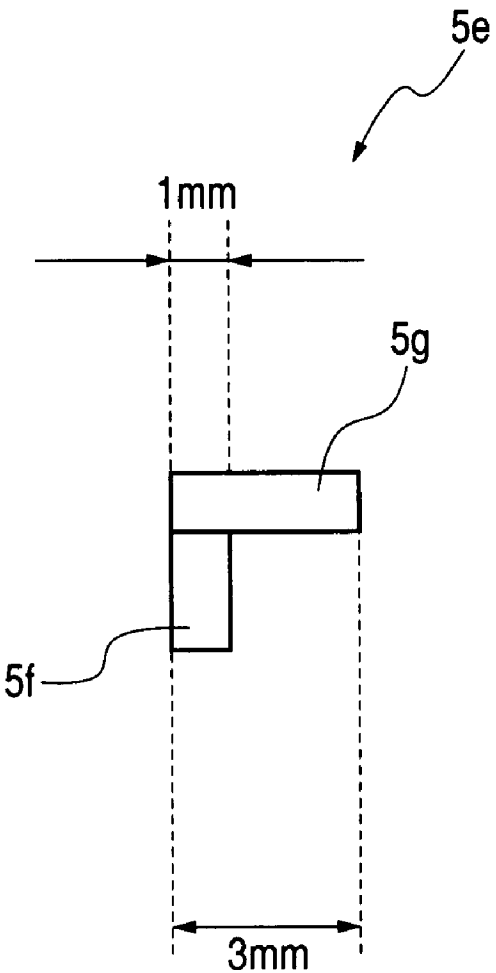
FIG. 12B is a cross-sectional view of the fin member of FIG. 12A.
Figure 12A:
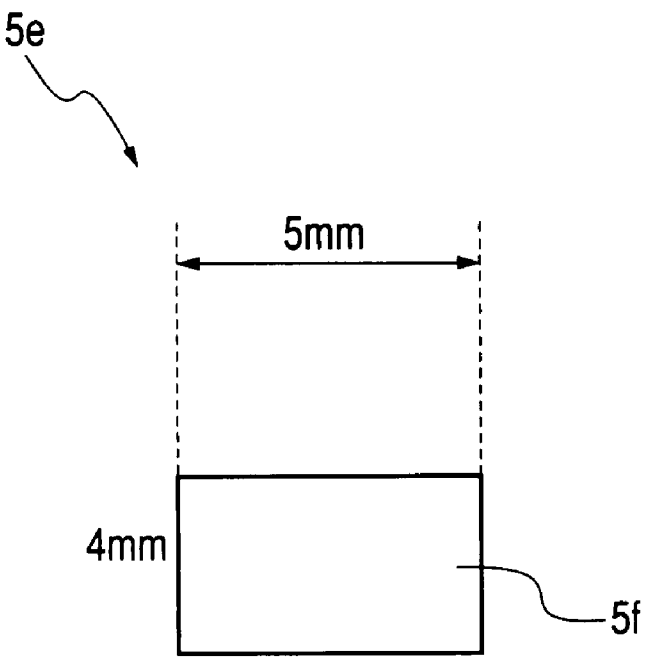
FIG. 12A is a front view showing another example of the fin member according to the present invention.

In the present embodiment, it is further necessary to sufficiently agitate the waste toner difficult to charge. So, as the screw 5*a*, a fin 5*e* shown in FIGS. 12A and 12B is provided on a screw shaft 5*b* shown in FIG. 1A. Then, the shape thereof is made such as shown in FIG. 12B which is a cross-sectional view taken in a thickness direction wherein a projected portion 5*g* is provided on the upper part of a fin plate portion 5*f* perpendicularly to the fin plate portion 5*f* in an upstream portion with respect to the rotational direction of the screw 5*a*. This fin 5*g* is attached and the screw shaft 5*b* is rotated, whereby the developer in the area surrounded by 5*f* and 5*g* can be more sufficiently agitated.

The developer level in the agitating chamber 5 in which there is installed the screw 5*a* provided with this fin 5*e* assumed a shape in which just beneath the toner supplying port 8, the screw shaft 5*b* floated up above the developer level during the rotation thereof. That is, the shaft 5*b* is higher than the developer level.

As in the present embodiment, the supplied toner used in the reuse image forming apparatus and having the waste toner mixed therewith usually has a degree of agglutination about three times as high as the order of 10% and therefore, is also disadvantageous for the introduction of the toner into the developer and thus, there is adopted a construction using the screw 5*a* which the fin 5*e* as described above is installed.

The attachment positions and number of the fins 5*e* on the screw 5*b*, as in the first embodiment, are along the condition that more fins 5*e* are provided in the second area spaced apart by a predetermined distance and more from the toner supplying port 8 toward the downstream side with respect to the developer carrying direction than in the first area B near the toner supplying port 8.

Thus, it is preferable to design the developer lever such that the screw shaft 5*b* can be seen, and by doing so, even the toner having the waste toner mixed therewith could be sufficiently agitated. Actually, the fog after ten sheets of images were formed after endurance of 50 k was 8% and manufacture was difficult, whereas in the present embodiment the fog could be suppressed to the order of 1.5%.

By adopting the above-described construction, there could be provided a developing apparatus tender to environments in that even in a compact developing apparatus in a toner reuse image forming apparatus, the faulty agitation of the toner can be prevented and the chargeability and agitatability of the toner can be maintained to thereby prevent spatter and fogging and images of high quality free of image unevenness can also be maintained in endurance, and waste matter is not turned out.

Third Embodiment

This embodiment relates to a case where in a compact developing apparatus similar in construction to the first embodiment, there is adopted a construction in which downstream of the toner supplying port 8, the developer is discharged from the developing container 10 to the outside thereof. This is a system in which in order to lengthen the service life of the developer for two-component developing, a small amount of carrier is mixed in advance with the toner to be supplied and also, the deteriorated carrier in the developing container 10 is discharged out of the developing container 10 with a result that the developer including the deteriorated carrier is replaced with a new developer and therefore the service life of the developer itself can be extended.

In the present embodiment, in a developing apparatus wherein such a lengthened service life was achieved, there was carried out the present invention which elevates the developer level on the downstream portion side of the toner supplying port 8 portion with respect to the developer carrying direction by the agitating screw 5*a*. The basic constructions of the image forming apparatus and the developing apparatus are similar to those in the first embodiment, and in FIG. 5, a discharging port 18 for the developer is provided in the wall surface of the developing container 10 in the P0 area of the downstream end portion of the agitating chamber 5 with respect to the developer carrying direction. In such a case, the developer level near the developer discharging port 18 must be higher than the uppermost point of the discharging port 18. This is because if the developer level is low, the supplied developer including the carrier will not be discharged even if it is accumulated. The discharging method in the present embodiment utilizes the fact that the carrying screw 5*a* is rotated, whereby the developer is moved and the discharging operation is performed.

Figure 13:
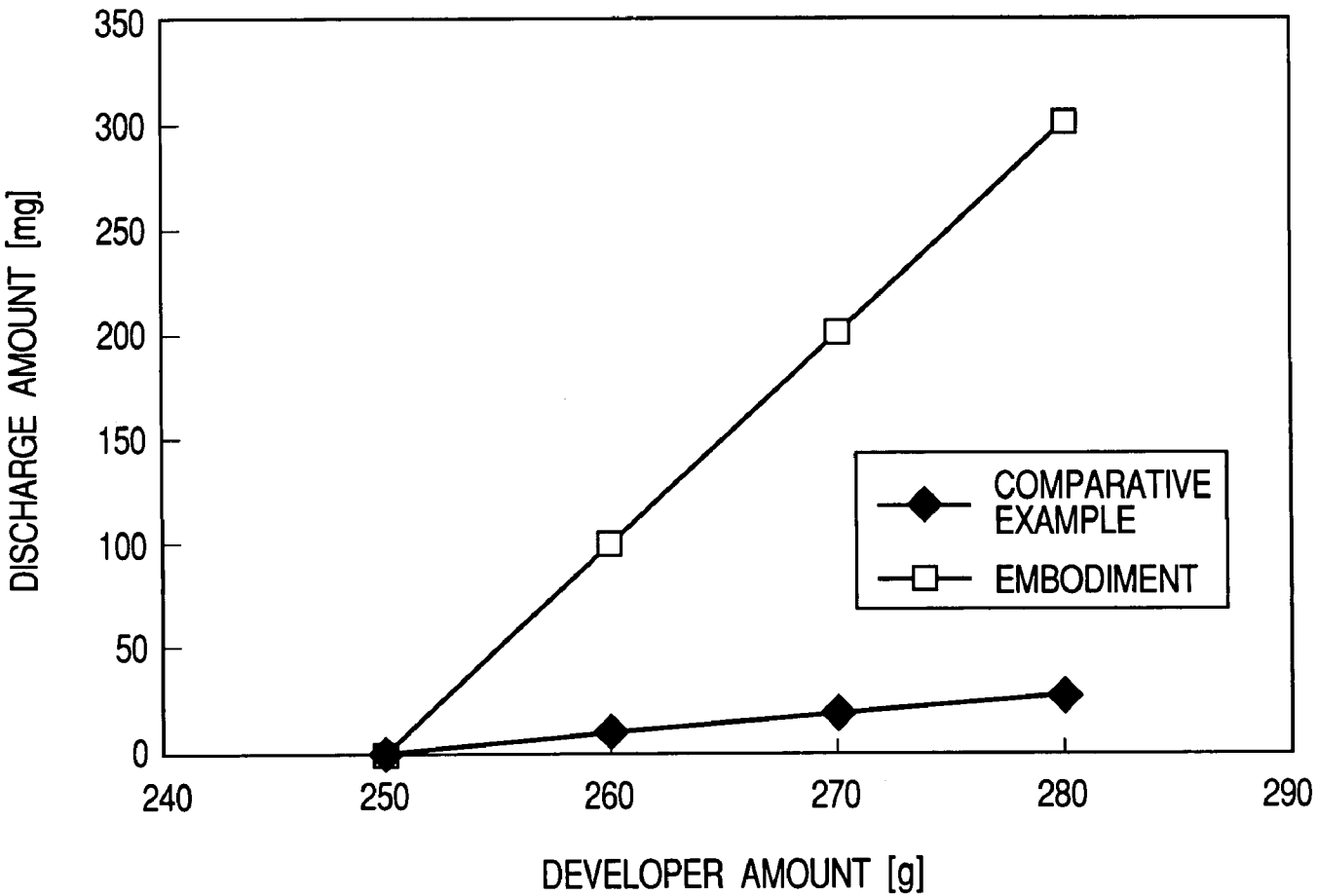
FIG. 13 is a graph showing the relations between a developer discharge amount and a developer amount in the developing container by another embodiment of the image forming apparatus according to the present invention and a comparative example.
Figure 14A:
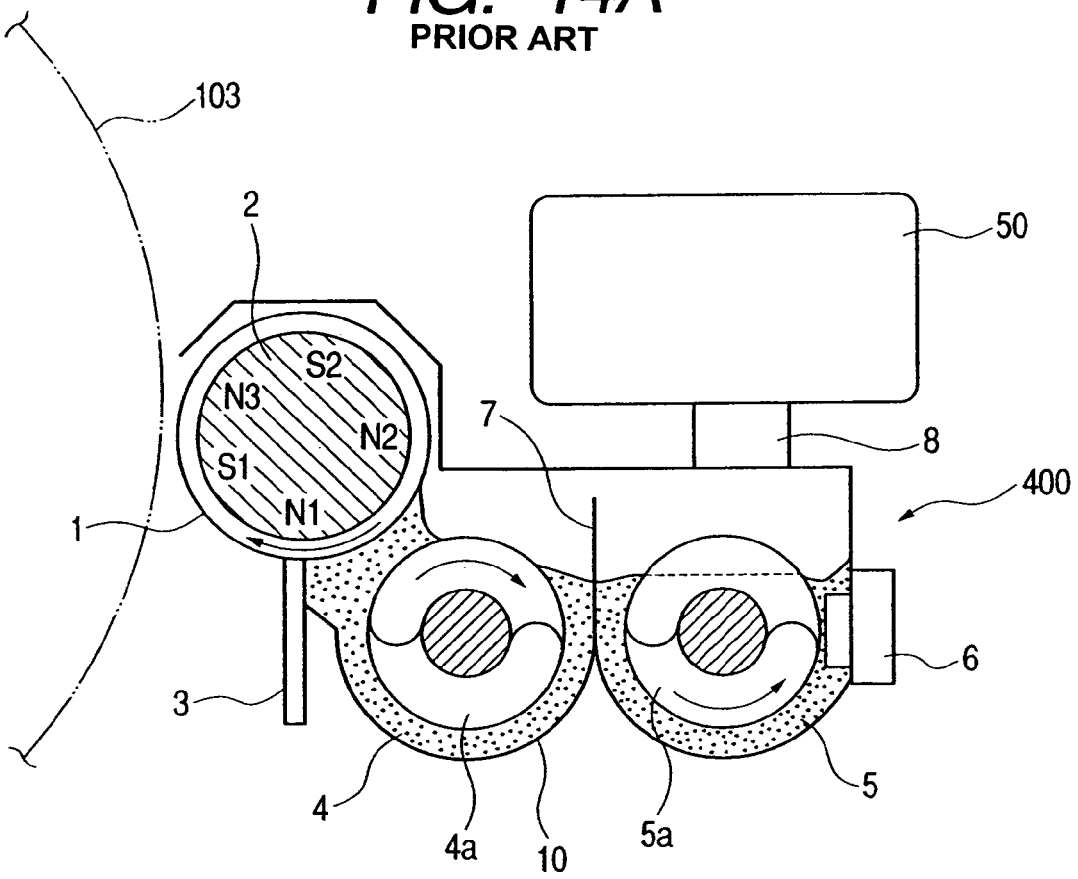
FIG. 14A PRIOR ART
FIG. 14A is a transverse cross-sectional view showing an example of a conventional developing apparatus.
Figure 14B:
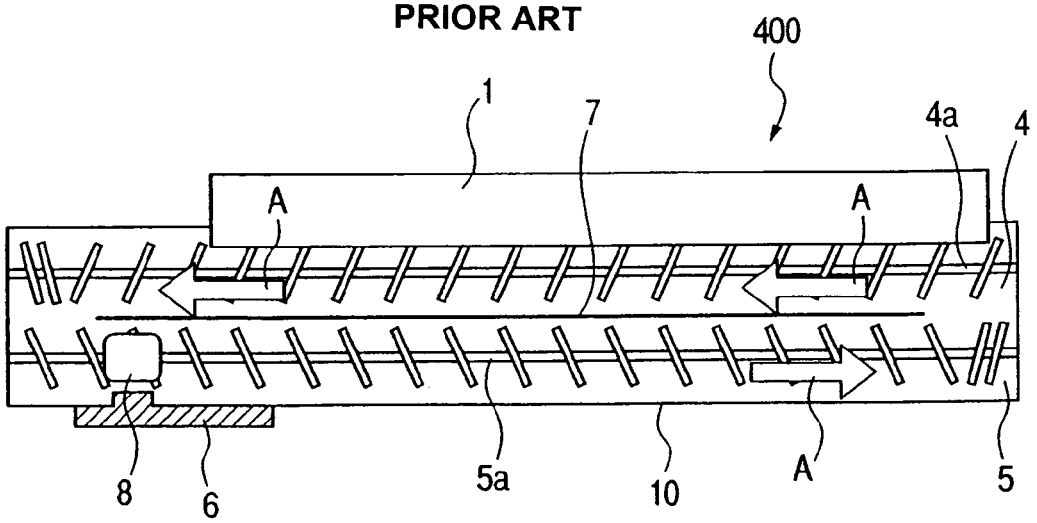
FIG. 14B PRIOR ART
FIG. 14B is a longitudinal cross-sectional view of the developing apparatus of FIG. 14A.

FIG. 13 shows the discharge characteristic when in the present construction, an opening portion is 15 mm×5 mm and the discharging port 18 has its height from the bottom surface of the developing container 10 determined to 19 mm in the P0 area of FIG. 5, and the developer discharge amount is recorded. A comparative example is one in which the horizontal developer level of the shape shown in FIG. 6A was elevated as much as possible. Any of them is arranged such that when the developer is increased, the developer equal to or higher than a predetermined height is discharged. The axis of abscissas represents the amount of developer in the developing apparatus 100.

When solid images continue to be formed, the carrier in the supplied developer suddenly enters the developing apparatus 100. At that time, it is necessary to discharge a predetermined amount within a predetermined time so that the interior of the developing apparatus 100 may not be filled up with the developer accumulated therein.

In the present embodiment, the percentage of the carrier in the supplied developer was 20% by weight ratio. The discharge amount necessary during the continuous forming of solid images in 200 mg. If the discharge amount is less than this amount, the developing apparatus will be filled up. With this point taken into account, from FIG. 13, it is seen that in the embodiment, 300 mg is discharged for the developer amount of 280 g, whereas in the comparative example, very little developer is discharged.

It is because the sensitivity to the increase in the volume of the developer in the developing apparatus 100 is small that in the comparative example, the discharge amount is small. Usually, when for example, 30 g of developer is added into the developing apparatus 100, the developer is generally dispersed and therefore, the developer level is little changed. In contrast, when use is made of a screw 5*a* similar to that in the first embodiment, and the discharging port 18 is provided in the second area downstream of the toner supplying port 8 wherein many fins 5*d* exist, a great rate of the added 30 g collects in this place because this construction originally has the characteristic of collecting the developer in the second area, and as a result, the sensitivity of the discharge characteristic becomes high to the amount of developer in the developing apparatus.

Again in another comparative example wherein the fins 5*d* are attached to the whole of the construction shown in FIG. 1B, the discharge amount is 50 mg, and this is small. This is because in this case, the whole area of the screw 5*a* is of the same shape and therefore, as the developer level, the developer is uniformly dispersed. Further, in an image, the developer level in the toner supplying port 8 portion rises and therefore, a fogged image and spatter are very bad and thus, manufacture cannot be done. In the present embodiment, as the service life of the developer, a life of 300 k could usually be achieved for the order of 50 k sheets. Also, even if subjected to such a limitation of the developer level, the supplied toner could be sufficiently agitated and therefore, a fog-free high quality of image could be maintained also by endurance.

As described above, again in the compact two-component developing apparatus having a toner collecting port provided at a predetermined height in the developing container, the longer service life of the developer could be achieved and also, the faulty agitation of the toner could be prevented, and the chargeability and agitatability of the toner could be maintained to thereby prevent spatter and fogging, and images of high quality free of image unevenness could also be provided in endurance.

By the constructions described above in the first to third embodiments, in a compact two-component developing apparatus and an image forming apparatus provided with the same, the faulty agitation of the toner can be prevented and the chargeability and agitatability of the toner can be maintained to thereby prevent spatter and fogging and even after endurance, a high quality of image free of image unevenness can be provided.

As described above, according to each of the above-described embodiment, even if the downsizing of the developing apparatus is continued, the faulty agitation of the supplied toner can be prevented and the charge amount of the toner can be improved to thereby prevent such phenomena as spatter and fogging, and provide a high quality of image free of image unevenness for a long period of time.

What is claimed is:

1. A developing apparatus comprising:

a first chamber for developing an electrostatic image formed on an image bearing member with a developer including a toner and a carrier;

a second chamber constituting a circulation route for the developer between said first chamber and said second chamber, said second chamber having a spiral developer feeding member for feeding the developer, a receiving port for receiving therein the supplied developer including the toner and the carrier, and a discharging port provided downstream of said receiving port with respect to a developer feeding direction for discharging an excess developer therethrough with the supply of the developer, wherein said developer feeding member has a plurality of agitating fins disposed so that a level of the developer near said receiving port may be lower than a level of the developer near said discharging port, and wherein the level of the developer at a location opposed to said receiving port is lower than a rotary shaft of said developer feeding member.

2. A developing apparatus according to claim 1, wherein said agitating fins are more provided near said discharging port than near said receiving port.

3. A developing apparatus according to claim 2, wherein said agitating fins are provided only at a location near said receiving port and opposed to said receiving port.

* * * * *

UNITED STATES PATENT AND TRADEMARK OFFICE

CERTIFICATE OF CORRECTION

PATENT NO. : 7,039,344 B2
APPLICATION NO. : 10/795258
DATED : May 2, 2006
INVENTOR(S) : Kazushige Nishiyama It is certified that error appears in the above-identified patent and that said Letters Patent is hereby corrected as shown below:

COLUMN 1

Line 13, "ratus a" should read --ratus, a--.

COLUMN 3

Line 45, "delivered" should read --it is delivered--; and
Line 67, "solve." should read --to solve.--.

COLUMN 5

Line 52, "arrow." should read --arrow--.

COLUMN 6

Line 66, "after γ-corrected" should read --after it is γ-corrected--.

COLUMN 7

Line 35, "and the magenta rotary 100c is rotated" should be deleted; and
Line 45, "arrow" should read --the arrow--.

COLUMN 9

Line 1, "1 an d the" should read --1 and the--;
Line 32, "developing bis" should read --developing bias--;
Line 41, "measured" should read --measured by--; and
Line 44, "Colter K.K.)." should read --Coulter K.K.).--.

COLUMN 10

Line 26, "maybe" should read --may be--;
Line 38, "styrene resin,." should read --styrene resin,--;
Line 39, "polyamide resin" should read --polyamide resin,--;
Line 50, "weight ration" should read --weight ratio--; and
Line 54, "(HIMER up 110" should read --(Himmer (trade name)--.

COLUMN 11

Line 37, "ration" should read --ratio--; and
Line 56, "if FIG. 3A," should read --in FIG. 3A--.

COLUMN 12

Line 31, "being" should be deleted; and
Line 38, "the screw 4*a* or screw 5*a* within the rotation range" should read --the rotation range of screw 4*a* or screw 5*a*.--.
Line 39, "thereof." should be deleted.

UNITED STATES PATENT AND TRADEMARK OFFICE

CERTIFICATE OF CORRECTION

PATENT NO. : 7,039,344 B2
APPLICATION NO. : 10/795258
DATED : May 2, 2006
INVENTOR(S) : Kazushige Nishiyama It is certified that error appears in the above-identified patent and that said Letters Patent is hereby corrected as shown below:

COLUMN 13
Line 16, "C (which" should read --C, which--.

COLUMN 14
Line 64, "prevision" should read --provision--.

COLUMN 15
Line 44, "arrow" should read --the arrow--; and
Line 54, "Describing" should read --Described--.

COLUMN 16
Line 6, "difficult" should read --which is difficult--;
Line 30. "which" should read --in which--;
Line 47, "tender" should read --sensitive--; and
Line 52, "fogging" should read --fogging,--.

COLUMN 18
Line 61, "more provided near" should read --provided more near to--; and
Line 62, "near" should read --to--.

Signed and Sealed this

Twenty-seventh Day of February, 2007

JON W. DUDAS
*Director of the United States Patent and Trademark Office*

UNITED STATES PATENT AND TRADEMARK OFFICE

CERTIFICATE OF CORRECTION

PATENT NO. : 7,039,344 B2
APPLICATION NO. : 10/795258
DATED : May 2, 2006
INVENTOR(S) : Kazushige Nishiyama It is certified that error appears in the above-identified patent and that said Letters Patent is hereby corrected as shown below:

Column 6
Line 42, "8 bits" should read --8 bits--; and

Column 13
Line 13, "fin-free" should read --a fin-free--; and

Column 14
Line 58, "provided at each" should read --provided every--.

Signed and Sealed this

Seventh Day of August, 2007

JON W. DUDAS
*Director of the United States Patent and Trademark Office*